United States Patent [19]

Donlan et al.

[11] 4,286,921

[45] Sep. 1, 1981

[54] LOCKING STRUCTURE FOR AN ALIGNMENT BUSHING OF A COMBUSTION TURBINE ENGINE

[75] Inventors: John P. Donlan, Aston, Pa.; Alfred R. Krauss, Oak Valley, N.J.

[73] Assignee: Westinghouse Electric Corp., Pittsburgh, Pa.

[21] Appl. No.: 103,136

[22] Filed: Dec. 13, 1979

[51] Int. Cl.[3] ..... F01D 25/24

[52] U.S. Cl. ..... 415/136; 415/171; 415/190

[58] Field of Search ..... 415/110, 136, 128, 139, 415/171, 172 A, 175, 189, 190, 216, 217, 218

[56] References Cited

U.S. PATENT DOCUMENTS

| | | | |
|---|---|---|---|
| 3,129,922 | 4/1964 | Rosenthal | 415/172 A |
| 3,408,048 | 10/1968 | Scalzo | 415/113 |
| 3,529,904 | 9/1970 | Scalzo et al. | 415/136 |
| 3,647,311 | 3/1972 | Wootton et al. | 415/113 |
| 3,829,233 | 8/1974 | Scalzo et al. | 415/110 |

FOREIGN PATENT DOCUMENTS

| | | | |
|---|---|---|---|
| 46-37521 | 11/1971 | Japan | 415/136 |

*Primary Examiner*—Leonard E. Smith
*Attorney, Agent, or Firm*—E. F. Possessky

[57] ABSTRACT

Locking structure for maintaining a set position in assembling an annular seal ring housing to a stationary inner shroud of an annular array of vane segments of a combustion turbine engine. This permits an adjustable assembly for obtaining concentricity between the seal and the adjacent rotor structure. Thus, the seal ring is mounted to the vane segments through an adjustable mounting arrangement that, upon assembly of the two, permits the seal ring to be aligned concentrically about the rotor. Once concentricity is obtained, the mounting components must be locked in such position to maintain such concentricity. The present invention provides a bracket attached to the adjustable mounting structure to lock it in the set position.

5 Claims, 4 Drawing Figures

LOCKING STRUCTURE FOR AN ALIGNMENT BUSHING OF A COMBUSTION TURBINE ENGINE

BACKGROUND OF THE INVENTION

1. Field of the Invention

This invention relates to an adjustable mounting arrangement between an inner stationary shroud and a seal ring housing for adjustably concentrically aligning the seal housing about a rotor and more particularly to locking structure for maintaining the mounting arrangement in the final concentric position.

2. Description of the Prior Art

U.S. Pat. No. 3,529,904, of common assignee as the present invention, describes an alignable annular seal housing ring mounted on the inner shroud of the vane segments of a gas turbine engine. The seal ring and inner shrouds have cooperating adjustable mounting structure that accommodates tolerance buildup during assembly of the parts and yet permits the seal ring to be mounted on the stationary segments concentric with the adjacent rotor with which the seal must cooperate to prevent leakage of the motive fluid. Also, the above-identified patent discloses a set-screw arrangement for locking the adjustable mounting structure once such concentricity is attained. However, it has been found that such locking structure requires a relatively time-consuming procedure during assembly and is generally relatively difficult to disassemble the locking structure for disassembly of the ring from the vane segments when it is necessary to repair the machine, especially in field repairs.

SUMMARY OF THE INVENTION

The present invention utilizes generally the variable mounting structure between the seal ring housing and the inner shroud of the vane segments as shown in the above-identified patent. However, the locking structure of the present invention is readily accessible for permitting disassembly of the parts and permits reuse of the parts providing the locking function. This is provided by a bracket member attached between a stationary part of the seal ring and an accessible portion of the adjustable mounting structure.

DESCRIPTION OF THE PREFERRED EMBODIMENT

In a combustion turbine engine of the corporate assignee of the present invention, the inner shroud of the stationary vane segments support a seal ring housing that has a seal portion thereof in sealing proximity to the rotating bladed rotor to minimize the escape of the motive fluid from its working flow path. The seal ring housing is mounted via an adjustable structure such that upon assembly thereof to the vane segments, the seal surface can be maintainwd concentric with the rotor thereby permitting relatively large tolerances in the fabrication of the parts and yet accommodating a tolerance buildup without effecting the final concentric relationship.

This adjustment is accomplished through turnable bushings disposed in the seal ring housing and having an off-set key or pin for engagement in a radial slot in an axially adjacent facing section of the inner shroud. Thus, turning the bushing causes the pin to travel in an arcuate path and radially adjusts the pin within the slotto, in cooperation with the other such pins on the seal ring housing, adjust the position of the seal ring to establish the desired concentricity. Once such concentricity is established, the bushing is positively retained in the proper position to maintain this relationship.

The above apparatus is clearly described in commonly owned U.S. Pat. No. 3,529,904 which is herein incorporated by reference for the detailed description of the seal ring housing to inner shroud assembly; however, the present invention provides an improved locking arrangement for the bushing.

Figure 2:
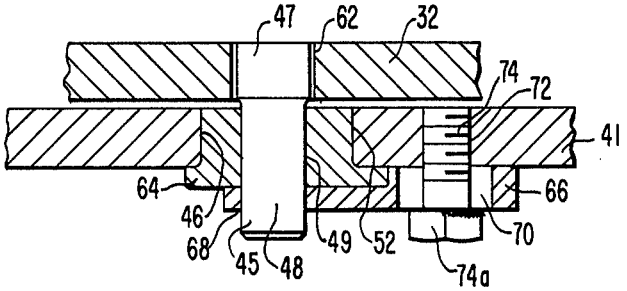
FIG. 2 is a view generally along line II-II of FIG. 1.
Figure 1:
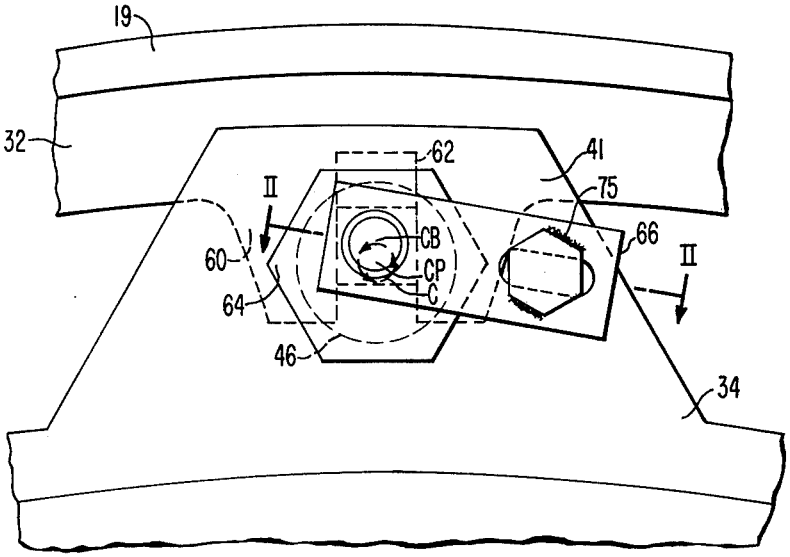
FIG. 1 shows a portion of a combustion turbine engine as viewed in the axial direction and showing the mounting arrangement between the inner shroud of the vane segment and the seal ring housing and one embodiment of the locking structure of the instant invention.

For correlation, the reference numbers of the incorporated patent will be used herein to identify common parts. Thus, referring to FIGS. 1 and 2 herein, the stationary vane segment has an inner shroud 19 with a radially inwardly extending rib 32 having separate further radially inwardly extending portions 60. Portions 60 define radially extending slots 62 open at the innermost radial end. The seal ring housing 34 has a radially outwardly extending rib portion 41 in axial facing relationship with portion 60. It should be noted that the seal ring housing, to withstand the elevated temperatures of its environment, is fabricated from a high temperature metal alloy such as a chromium alloy that is generally non-weldable.

A generally cyclindrical bushing 46 is received in a cylindrical opening 52 in rib portion 41 in general axial alignment with the slot 62. The bushing 46 defines a hexagonal head 64 projecting from the surface of the rib 41 opposite the shroud 19 for engagement by a tool to turn the bushing 46 within the opening 52.

The bushing 46 defines an axial cylindrical opening 49 therethrough and in which is mounted a pin 45 having a cylindrical portion 48 projecting through the opening 49 on the side of the hex-head 64 and a rectangular portion 47 sized to snugly fit within the slot 62 of the rib 32 on shroud 19.

It should be noted that the center CP of the pin 45 is off-set from the center CB of the bushing 46 so that rotation of the bushing 360° permits adjustment of the center of the pin along the circle C. Such arcuate movement, capable in each mounting engagement between the inner shroud 19 and the seal ring housing 34 permits sufficient assembly adjustment to provide concentricity of the seal ring to the adjacent rotor (not shown).

Once the proper adjustment has been obtained it is necessary to lock the pin 45 and bushing 46 in such final position. Thus, in this regard, the present invention provides a bracket member 66 comprising a generally rectangular metal (i.e. stainless steel) bar having a circular opening 68 at one end sized to snugly receive the cylindrical projecting end 48 of the pin 45 therethrough, and an enlarged opening 70 at the opposite end in opposed facing relationship with the rib portion 41 of the seal ring housing.

A threaded aperture 72 in the seal ring housing in alignment with the elongated opening 70 receives a bolt 74 which is tightened into the aperture against the bracket 66. During adjustment for concentricity, the bolt remains relatively loose, and the elongated opening accommodates the change in distance between the center of the pin and the center of the threaded aperture as the adjustment is made. However, once such adjustment is final, the bolt 74 is tightened and subsequently the head 74*a* thereof is welded as at 75 to the bracket 66 (i.e. both bolt and bracket ring formed from a field weldable metal such as stainless steel). This positive engagement between bracket 66 and bolt 74 then prevents the pin 45 from any further arcurate movement and positively anchors the mounting structure in place.

During disassembly of the turbine for repair of the separate parts, the weld 75 can be ground away as it is in a readily accessible area, and the bolt 74 removed and the ring disassembled from the shroud. Such above enumerated parts are then ready to be reused when the machine is again assembled.

Figure 4:
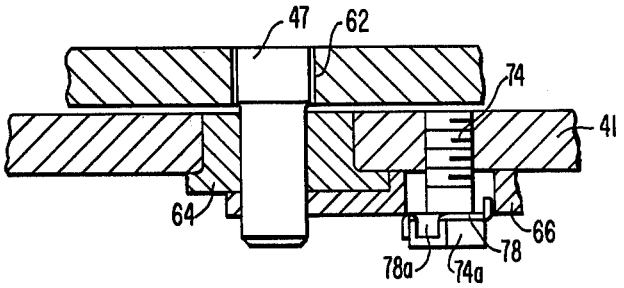
FIG. 4 is a view generally along lines IV-IV of FIG. 3.
Figure 3:
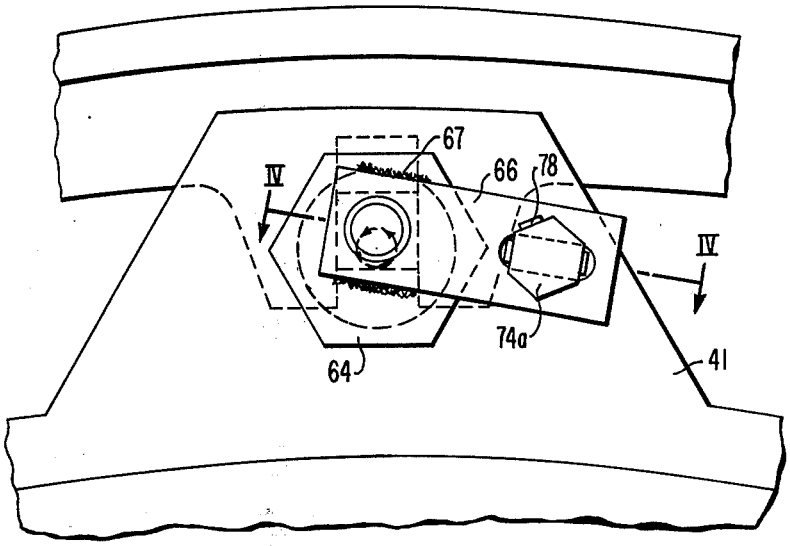
FIG. 3 is a view similar to FIG. 1 of a second embodiment of the present invention.

FIGS. 3 and 4 show another embodiment of the anchoring arrangement in that once the adjustment has been made as above described, the bracket 66 is welded to the head 64 of the bushing (which is also formed from a field weldable metal) as a t 67. With this arrangement it is seen that any arcuate movement of the pin 45 would require rotation of the bracket 66, which rotation is again prevented by the bolt 74 so that the pin is anchored in the final position. A locking nut 78 is then deformed around the head of the bolt 74 (i.e. one tab 78*a* of the nut is bent into engagement with the bolt head) to prevent vibration from loosening the bolt from the rib 41. Again, to disassemble the parts, the weld 67 is machined away and the tab 78*a* is bent to a position of non-interference with the head 74*a* so the bolt can be removed and the seal ring housing disassembled from the shroud.

We claim:

1. In an adjustable mounting arrangement between an axially facing adjacent arcuate seal ring and an inner shroud of a combustion turbine engine to permit concentric alignment of the seal ring with an adjacent rotor, means for locking said adjustable arrangement in a final concentric position, wherein said mounting arrangement includes an axially extending rotatable bushing in said seal ring and a pin, offset from the center of rotation of said bushing, projecting axially through said bushing and having one end slidably received within a radially extending slot in said shroud and wherein said locking means comprises:

means engaging the other end of said projecting pin, said means extending to a position adjacent the face of said seal ring opposite said shroud; and, means for securing the engaging means to said sealing face.

2. Structure according to claim 1 wherein said engaging means includes:

a bracket member having a first aperture adjacent one end snuggly receiving therethrough said other end of said pin, and a second aperture adjacent the opposite end and elongated in the direction of said first aperture; and, said receiving means includes:

a threaded opening in said face of said seal ring in alignment with said second aperture;

a bolt threaded into said opening and tightened to engage said bracket through said opening to prevent translational movement of said bracket and arcuate movement of said pin once final positioning of said pin is established; and, means for preventing said bolt and bracket from normally becoming disengaged.

3. Structure according to claim 2 wherein said means preventing disengagement between said bolt and said bracket include a weld therebetween.

4. Structure according to claim 2 wherein said shroud and said ring are formed of a high temperature alloy and said bushing, bracket and bolt are all formed of a lower temperature alloy for relatively easy field welding thereof.

5. Structure according to claim 4 wherein said low temperature alloy is a stainless steel.

* * * * *